US006557851B2

(12) United States Patent
Gauthier et al.

(10) Patent No.: US 6,557,851 B2
(45) Date of Patent: May 6, 2003

(54) LOTTERY TICKET PLAY ACTION GAME

(75) Inventors: Katia Gauthier, Montreal (CA); Carla Schaefer, San Antonio, TX (US)

(73) Assignee: Oberthur Gaming Technologies, Inc, Montreal (CA)

( * ) Notice: Subject to any disclaimer, the term of this patent is extended or adjusted under 35 U.S.C. 154(b) by 0 days.

(21) Appl. No.: 09/966,959

(22) Filed: Sep. 28, 2001

(65) Prior Publication Data

US 2002/0109294 A1 Aug. 15, 2002

Related U.S. Application Data

(60) Provisional application No. 60/236,196, filed on Sep. 29, 2000.

(51) Int. Cl.[7] ..... A63F 3/06

(52) U.S. Cl. ..... 273/139; 273/269; 283/901; 283/903

(58) Field of Search ..... 273/269, 271, 273/272, 139; 283/901, 903

(56) References Cited

U.S. PATENT DOCUMENTS

| | | | | | |
|---|---|---|---|---|---|
| 2,684,853 | A | * | 7/1954 | Withers | 273/139 |
| 3,877,703 | A | * | 4/1975 | Pierre | 273/272 |
| 4,252,322 | A | * | 2/1981 | Orter | 273/269 |
| 4,491,319 | A | | 1/1985 | Nelson | |
| 5,112,058 | A | | 5/1992 | Sandeen | |
| 5,411,260 | A | | 5/1995 | Smith | |
| 5,685,541 | A | * | 11/1997 | Lovell | 273/139 |
| 6,241,246 | B1 | * | 6/2001 | Guttin et al. | 273/139 |

* cited by examiner

*Primary Examiner*—Benjamin H. Layno
(74) *Attorney, Agent, or Firm*—Watov & Kipnes, P.C.

(57) ABSTRACT

A lottery ticket having a first play area including a preselected number of pairs of adjacent play symbols, and a second play area including a plurality of intersecting rows, each row having at least two regions with each region containing a play symbol, wherein the player matches the pairs of symbols from the first play area with the same play symbols in adjacent regions of the second play area and a prize is won if the player completes a sufficient number of play symbols in the second play area.

12 Claims, 3 Drawing Sheets

LOTTERY TICKET PLAY ACTION GAME

This application claims the benefit of provisional application No. 60/236,996 filed Sep. 29, 2000.

FIELD OF THE INVENTION

The present invention is directed to a lottery ticket in which the play action game provides for the player to match pairs of adjacent play symbols in a first play area with corresponding adjacent symbols in a second play area. The player may win a prize if he or she matches a minimum number of adjacent play symbols in the second game area with the pairs of adjacent play symbols which are available to the player from the first play area.

BACKGROUND OF THE INVENTION

Scratch-off lottery tickets are common in the lottery industry. Game data is covered by a scratch-off layer and when the scratch-off layer is removed, the game data is exposed. Once the scratch-off layer is removed, if the game symbols provide a certain pattern (e.g. three of the same symbol) the player may win a prize. Thus, the typical scratch-off lottery tickets require the player to remove the scratch-off layer and immediately determine what prize has been won.

It is desirable in the scratch-off lottery industry to provide lottery tickets which not only provide the opportunity to win a prize, but also provide the opportunity to play a game which adds to the value and entertainment of the lottery ticket itself. It would therefore be a significant advance in the scratch-off lottery industry to provide a lottery game which can be based on chance and provide the player an opportunity to play a game and the possibility of winning a valuable prize.

SUMMARY OF THE INVENTION

The present invention is generally directed to a lottery ticket having a first play area which includes pairs of adjacent play symbols. These adjacent pairs of play symbols may or may not appear in a second play area. If a pair of adjacent play symbols from the first play area is found in a second play area there is a match. If the player obtains a sufficient number of matches of symbols in the second play area from those available in the first play area, a prize may be won.

In a particular aspect of the present invention, there is provided a lottery ticket comprising a first play area comprising a preselected number of pairs of adjacent play symbols, and a second play area comprising a plurality of rows, each row comprising at least two regions with each region containing a play symbol. The player matches the pairs of symbols from the first play area with the same play symbols in adjacent regions of the second play area. A prize is won if the player completes a sufficient number of play symbols in the second play area such as, but not limited to, the completion of an entire row of play symbols or matches a sufficient number of play symbols from the first play area to the second play area. In one aspect of the present invention, the rows are comprised of horizontal and vertical rows wherein a prize may be won by the completion of at least one entire vertical or horizontal row of play symbols. In a further aspect of the invention, a prize may be won by obtaining a sufficient number of matched play symbols from the first play area to the second play area.

The lottery ticket of the present invention may provide a single first play area or may provide multiple first play areas.

In the latter embodiment of the invention, the player tries to obtain more matches from the player's preselected first play area than the number of matches obtained from the other first play areas.

In a still further aspect of the present invention the play area may be provided with one or more bonus regions which may contain a bonus play symbol which provides an automatic prize winning key symbol, a universal play symbol or the like.

BRIEF DESCRIPTION OF THE DRAWINGS

The following drawings in which like reference characters indicate like parts are illustrative of embodiments of the present invention and are not intended to be limited to the invention as disclosed in the application.

DETAILED DESCRIPTION OF THE INVENTION

Figure 1:
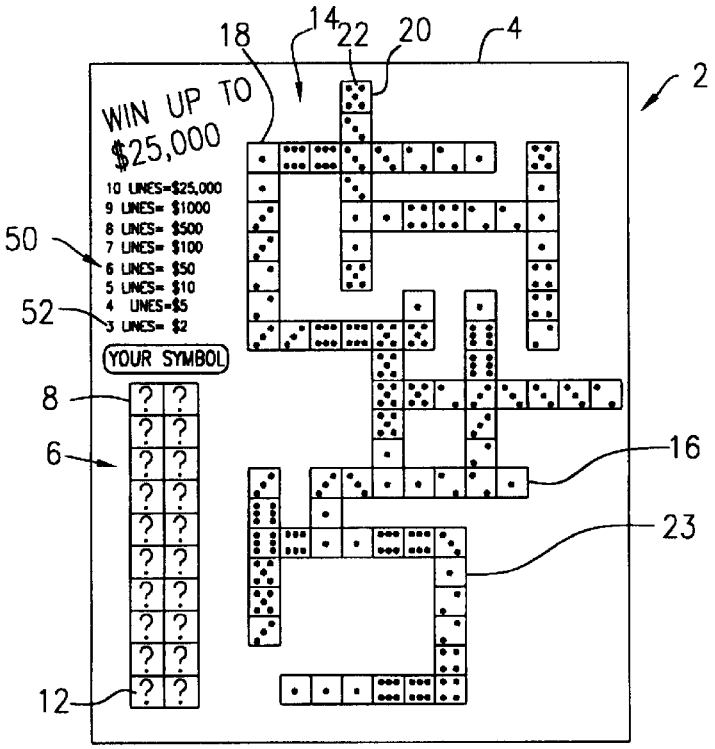
FIG. 1 is a top view of an embodiment of a lottery ticket of the present invention showing a first play area with a plurality of adjacent play symbols covered by a scratch-off layer and a second play area containing horizontal and vertical rows with each row containing pairs of adjacent play symbols.
Figure 2:
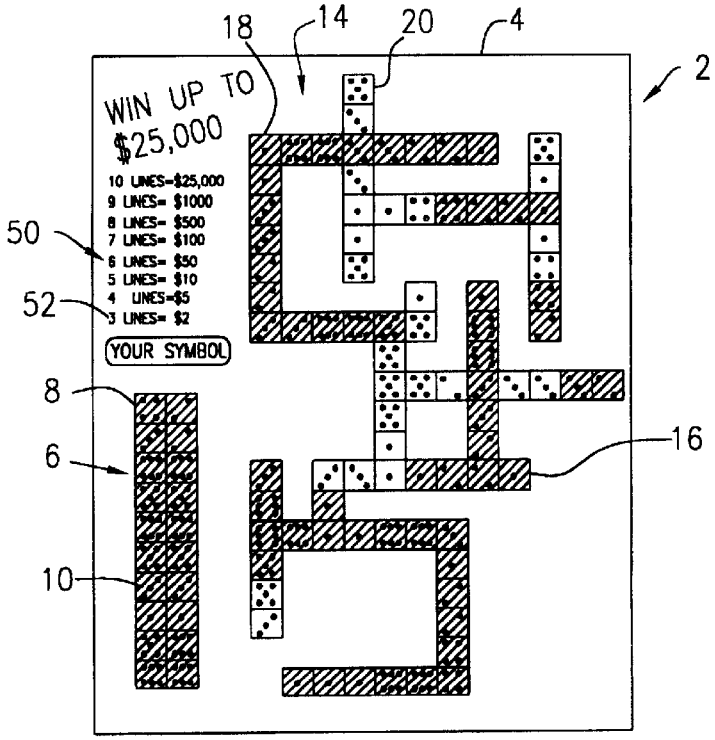
FIG. 2 is a top view of the embodiment shown in FIG. 1 in which the adjacent play symbols in the first play area are exposed and some of the adjacent pairs of play symbols in the second game area have been located.

Referring to FIGS. 1 and 2 there is shown a lottery ticket as a first embodiment of the present invention. The lottery ticket 2 has a top face 4 which includes a first play area 6 containing pairs of adjacent play regions 8. Each pair of adjacent play regions 8 contains play symbols 10 (see FIG. 2) covered by a scratch-off layer 12 as shown in FIG. 1.

There is also provided a second play area 14 which may have a variety of different formats including rows, circles, other geometric shapes such as triangles and other polygons and each containing at least two play regions 20 with each play region containing a play symbol. As shown specifically in FIGS. 1 and 2, the second play area 14 contains a series of horizontal rows 16 and vertical rows 18. Each row 16 and 18 contains at least two play regions 20 with each play region 20 containing a play symbol 22 which may be covered by a scratch-off layer 23 that when removed enables the player to differentiate between completed play regions (i.e. containing one of the play symbols from the first play area 6) and an uncompleted play region (i.e. not containing one of the play symbols from the first play area 6). When horizontal rows 16 and vertical rows 18 are used it is preferred, at least in some instances, that the rows intersect with each other perpendicularly or at a diagonal.

In the embodiment shown in FIGS. 1 and 2, the player removes the scratch-off layer 12 from the adjacent pairs of play regions 8 to thereby reveal play symbols 10. In the embodiment shown specifically in FIG. 2, the first adjacent pair of play symbols 10 is the number "4" followed by the number "2". The player then goes to the second play area 14 and locates all instances of adjacent pairs of symbols which have both the numbers "4" and "2". These corresponding adjacent pairs of play symbols may be marked as described hereinafter and the process is repeated for each adjacent pair of play symbols 10 appearing in the first play area 6. Again referring specifically to FIG. 2, the adjacent pair of play indicia "4" and "2" in the first play area is marked in the second play area 14 so that all instances of "4" and "2" adjacent to each other are marked in the second play area 14. The process is then repeated for the next adjacent pair of play indicia "3" and "2" appearing in the first play area until all adjacent pairs of play symbols in the first play area 6 are marked in the second play area 14.

A prize may be won if one or more complete horizontal rows 16 or vertical rows 18 are completed by properly matched adjacent pair of symbols from the first play area 6 as may be illustrated in an optional prize designation area 50 containing a prize 52 for completing a predetermined number of horizontal or vertical rows (i.e. referred to in FIGS. 1 and 2 as "lines"). Alternatively, a prize may be won if the player achieves at least a minimum number of matches of adjacent play symbols from the first play area to the second play area. In this embodiment the prize designation area 50 may refer to play symbols (instead of lines) to determine if a prize 52 has been won.

It will be understood that the play symbols in the first play area 6 and the second play area 14 may be any play symbols including letters, symbols, icons, signs and the like. It will be also understood that horizontal and vertical rows may be at least in part replaced by diagonal rows or other geometrics shapes such as circles or polygons having at least three sides such as triangles.

Figure 3:
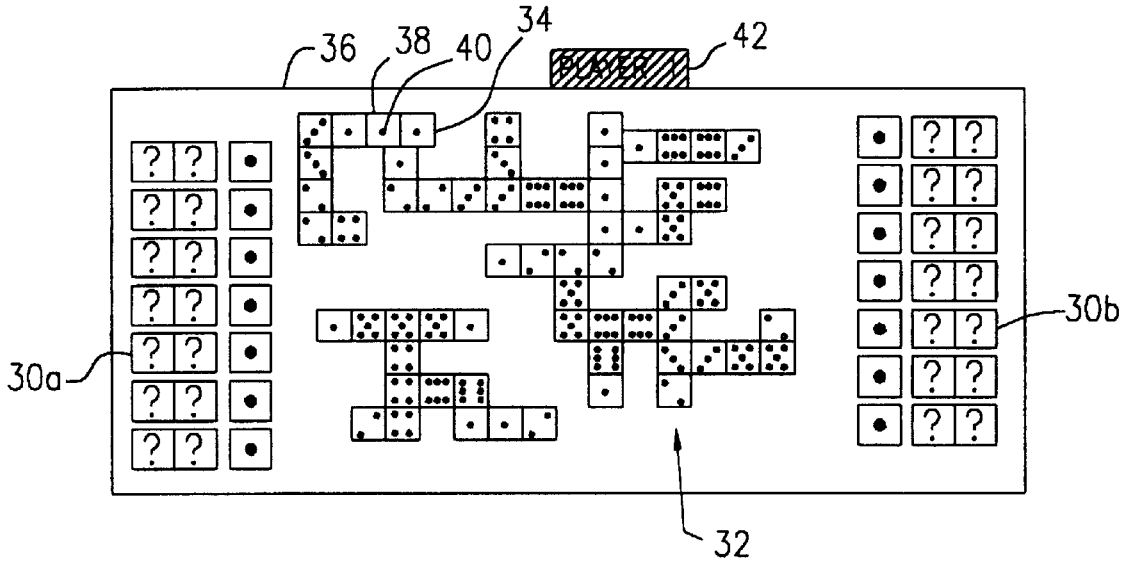
FIG. 3 is a top view of another embodiment of the lottery ticket of the present invention providing two first play areas in which the player has a preselected first play area which competes against a hypothetical player employing the other first play area.
Figure 4:
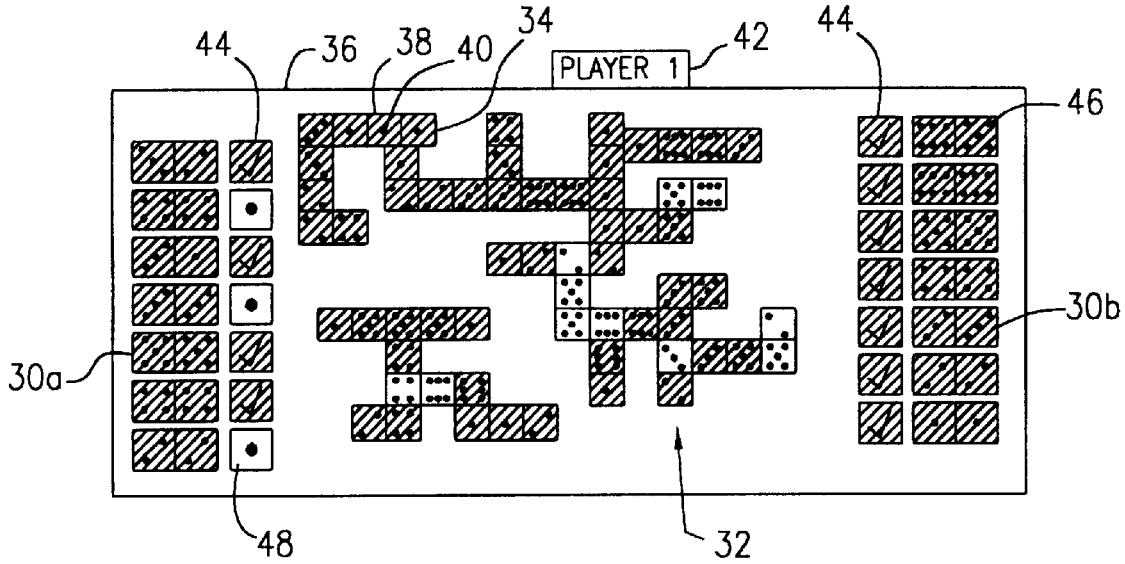
FIG. 4 is top view of the embodiment shown in FIG. 3 in which the play symbols in the first play areas have been exposed and the number of matches identified.

A second embodiment of the present invention is shown in connection with FIGS. 3 and 4. There is provided a plurality of first play areas. As specifically shown in FIGS. 3 and 4, there are two first play areas 30*a* and 30*b*. Each of the first play areas is constructed in the same manner as that described in connection with the embodiment of FIGS. 1 and 2. There is also provided a second play area 32 comprised of horizontal rows 34 and vertical rows 36. Each row 34, 36 contains a plurality of play regions 38 each containing play symbol 40.

The embodiment of FIGS. 3 and 4 provides for the opportunity of the player to "compete" against another, hypothetical player. Unlike the embodiment of FIGS. 1 and 2, the object of the game in FIGS. 3 and 4 is to provide more matches than the hypothetical player.

The player first removes a scratch-off layer from a third play area 42 which, when the scratch-off layer is removed, identifies whether the player will be playing as player number one or as player number two. As shown in FIG. 4, removal of the scratch-off layer reveals that the player in this embodiment will play as player number one. In one embodiment, a game of chance is provided wherein the instructions on the lottery ticket from a lottery sponsor (e.g. State Lottery Commission) determine the player number to be played by the user of the ticket. In another embodiment, a probability game is provided wherein the user of the ticket can select which player number he or she wishes to play. In a further embodiment there is a single player and the player wins by achieving at least a minimum number of matches of adjacent pairs of play symbols designated on the lottery ticket in the prize designation area 50.

As shown in FIG. 4, this particular game has the player playing as player number one against the hypothetical player playing as player number two. The player then removes the scratch-off layer from the first play area 30*b* to reveal a plurality of adjacent pairs of play symbols which are marked by the player in the second play area 32. Each time there is a match of a pair of adjacent play symbols, the player identifies the match.

In the embodiment shown in FIGS. 3 and 4, the identification of a match is made in a marking region 44 which is comprised of a box 46 having a check mark (see FIG. 4) 46 or some other indicia beneath a scratch-off layer 48. As shown specifically in FIG. 4, the first pair of adjacent play symbols "6" and "3" for player number two is located in the second play area 32. Accordingly, the player removes the scratch-off layer 48 from the box 44 to reveal a check mark indicative of a match in the second play area 32. The player then repeats this process for all of the adjacent pairs of play symbols in the first play area 30*b*. The number of matching pairs of play symbols within the second play area 32 is noted by the check marks and the total number of check marks represents the players score. Thus, player number two has a total score of seven because all seven of the adjacent pairs of play symbols found a corresponding match in the second play area 32.

The process is then repeated for the hypothetical player (player number one in the embodiment shown in FIGS. 3 and 4) with the result that only four matches are found. Because the player number two has more matches than the player number one and because the player of the game is in fact player number one in accordance with the instructions within the third play area 42, the lottery ticket is a losing ticket.

As previously indicated, the second play area in each of the embodiments of FIGS. 1–5 may be marked when a match is found which is helpful to the player to keep track of which pairs of adjacent symbols are present in the second game area.

The second play area may be marked as described above by employing a dual transparent scratch-off system as disclosed in U.S. Pat. No. 6,076,860 incorporated herein by reference. A dual transparent layer system is employed including at least one clear, transparent scratch-off layer covering the play indicia and at least one colored transparent layer thereover which is made from a non-scratch-off material. The non-scratch-off material is joined to the scratch-off layer by imprinting directly thereon such that removal of the transparent scratch-off layer also removes the transparent non-scratch-off layer.

Other systems which may be used to mark the second play area include the printing techniques disclosed in U.S. Reissue Pat. No. 34,673 entitled "Two Level Scratch Game" and U.S. Pat. No. 5,386,985 entitled "Instant Bingo Game Card", each of which is incorporated herein by reference. Of course, the second play area may be marked in a conventional way by the player such as by using a pencil, marker, pen or other marking instrument.

In a further embodiment of the invention, one or more regions in the second play area may be provided with a bonus symbol to provide assistance in playing the game and/or to allow the player to have the opportunity to win an additional prize. The bonus symbol may be any symbol, icon, sign and the like which is different than the play symbols used to play the game.

Figure 5:
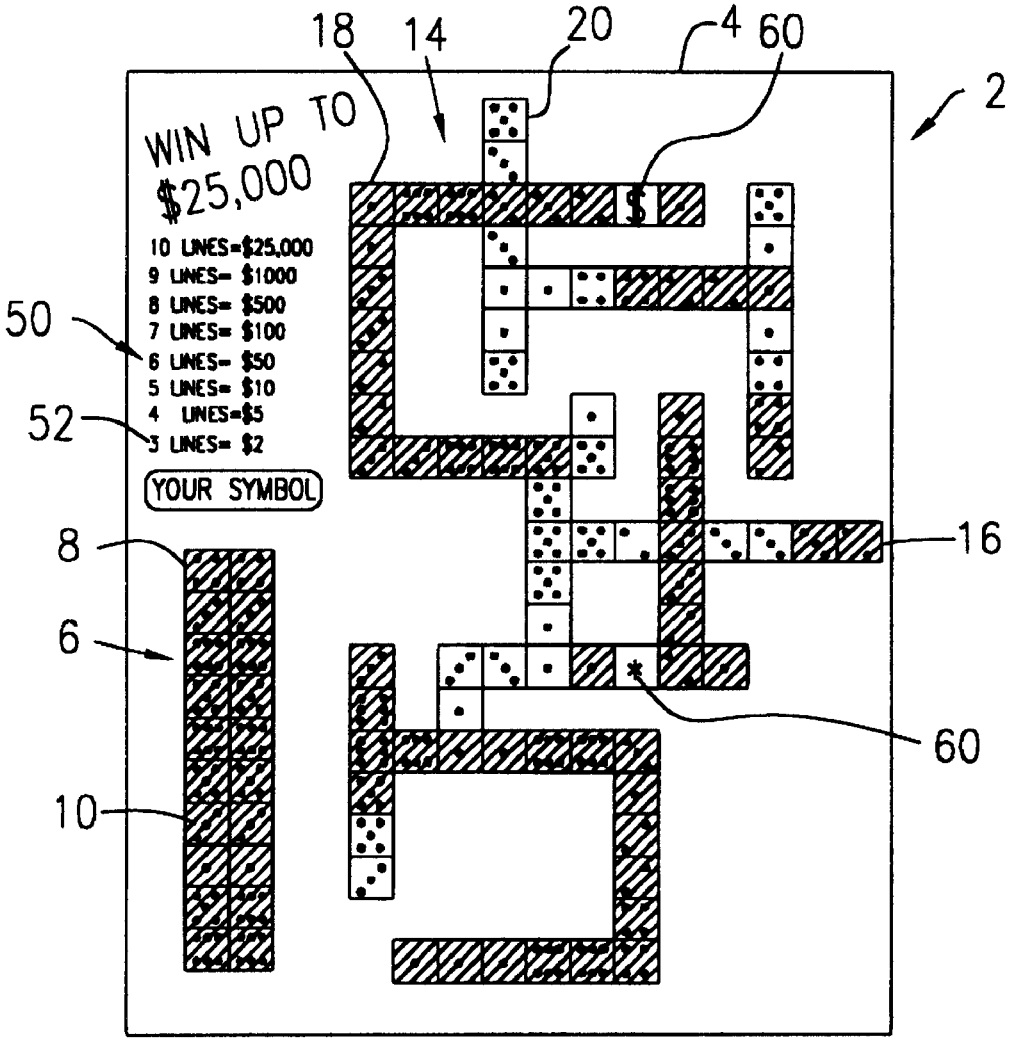
FIG. 5 shows an embodiment of the invention similar to FIG. 2 containing multiple bonus play symbols.

Referring to FIG. 5, there is shown a lottery ticket 2 very similar to the one shown in FIG. 2. A bonus symbol 60 appears in the top most horizontal row 16. The symbol in the form of a dollar sign is indicative that a monetary bonus prize has been won such as $5. The amount of the prize may appear in the individual play region or space may be provided in the prize designation area 50. The bonus symbol can also be a symbol representing a multiplier, a total prize won, an instant win or other prize designating symbols.

As further shown in FIG. 5, one of the horizontal rows 16 has a play region 20 containing a bonus symbol 60 in the form of a star. This bonus symbol 60 may function as a wild card such as by enabling the player to consider the star to be any play symbol which may facilitate the completion of the horizontal row.

Modifications of the present invention will be apparent to those of ordinary skill in the art and include the use of additional or other types of play indicia as well as multiple first play areas so that additional hypothetical players may be involved in the game.

What is claimed is:

1. A lottery ticket comprising a first play area comprising at least one set of preselected pairs of adjacent play regions each play region containing a play symbol thereby defining a number of pairs of adjacent play symbols, wherein each pair of adjacent play regions in the first play area are separated from each other pair of adjacent play regions, and a second play area comprising a plurality of intersecting rows, each row comprising at least two play regions with each play region containing a play symbol such that the play symbols in two adjacent regions define a pair of adjacent play symbols for the second play area, wherein a match is made if a pair of adjacent play symbols from the first play area finds correspondence with the same pair of adjacent play symbols in the second play area, and wherein a prize is won if the player obtains a preselected minimum number of matches.

2. The lottery ticket of claim 1 wherein the play symbols are in the form of numbers or representatives thereof.

3. The lottery ticket of claim 1 wherein the second play area comprises a plurality of intersecting horizontal and vertical rows.

4. The lottery ticket of claim 3 further comprising identification means for identifying which pair of adjacent play symbols from the first play area is present in the second play area.

5. The lottery ticket of claim 4 wherein the identification means comprises a box adjacent each pair of adjacent play symbols in the first play area, and an identifying indicia within each box which is exposed when the player determines that the pair of adjacent play symbols in the first play area is present in the second play area.

6. The lottery ticket of claim 3 further comprising play selection means for identifying which set of the preselected number of pairs of adjacent play symbols will be played by the player.

7. The lottery ticket of claim 1 wherein a prize is won if the player obtains all of the matches in at least one row of the second play area.

8. The lottery ticket of claim 7 wherein a prize is won if a player completes all of the matches in at least one horizontal row, vertical row or combination thereof.

9. The lottery ticket of claim 1 comprising at least two first play areas with one of said first play areas being the player's first play area and at least one other of said first play areas being a hypothetical opponent's first play area.

10. The lottery ticket of claim 9 wherein the player determines which first play area shall be the player's first play area.

11. The lottery ticket of claim 9 wherein a lottery sponsor determines which first play area shall be the player's first play area.

12. The lottery ticket of claim 1 wherein at least one of the regions in the second play area contains a bonus symbol.

* * * * *